United States Patent [19]

Miller

[11] Patent Number: 4,553,946

[45] Date of Patent: Nov. 19, 1985

[54] ACTION TOY AND GAME

[75] Inventor: R. Lee Miller, Grand Rapids, Mich.

[73] Assignee: Hilco House, Inc., Grand Rapids, Mich.

[21] Appl. No.: 595,822

[22] Filed: Apr. 2, 1984

Related U.S. Application Data

[63] Continuation-in-part of Ser. No. 437,368, Oct. 28, 1982, Pat. No. 4,457,097.

[51] Int. Cl.[4] ..... A63H 3/14

[52] U.S. Cl. ..... 446/327; 446/334

[58] Field of Search ..... 446/327, 330, 334, 335, 446/336

[56] References Cited

U.S. PATENT DOCUMENTS

| | | | |
|---|---|---|---|
| 1,853,733 | 4/1932 | Lane | 446/334 |
| 2,716,840 | 9/1955 | Armstrong | 446/334 |
| 4,457,097 | 7/1984 | Miller et al. | 446/327 |

*Primary Examiner*—Mickey Yu

*Attorney, Agent, or Firm*—Michael A. Painter

[57] ABSTRACT

A puppet toy and game which includes a configured body support having pivotally connected thereto an operable limb assembly in which an upper arm is pivotally connected to the body support. A forearm is integrally extended from the upper arm and is moveable with respect thereto. A trigger activates the upper arm and forearm to extend the limb assembly into a striking position. A resilient return element means returns the limb assembly to an at-rest position, with the trigger being located relative to the body support so as to allow an operator to grasp and carry the body support in one hand while controlling the trigger simultaneously with the same hand. A head is resiliently carried upon the body support to allow the head to return to its original position after being struck, and in toys in which a plurality of limb assemblies are provided, the trigger or levers are located to allow an operator to control the limb assemblies either independently or simultaneously with the same finger or thumb.

6 Claims, 5 Drawing Figures

ACTION TOY AND GAME

This application is a continuation-in-part of pending application Ser. No. 437,368 filed Oct. 28, 1982, U.S. Pat. No. 4,457,097.

BACKGROUND OF THE INVENTION

Puppets and dolls having a wide variety of opertable features have long been known in the art. Such puppets or dolls find use primarily in the entertainment of children. Quite often children are particularly entertained by puppets or dolls which provide some operative movement which serves to hold the child's attention. Particularly interesting to children are puppets which require little or no instruction and limited manual dexterity to operate, so that the children can themselves control the puppet's actions.

In addition to the desirability of being entertaining to children, it is desirable that a puppet or toy be inexpensive to manufacture, both in its simplicity of design and the minimal requirement of materials used in manufacture. It is often the case that the less complicated a toy the less likely the toy is to break, which is also a desirable function of devices subject to abusive operation. Since such puppets or otys are used primarily by children, however, even relatively simple devices can break. In such situations it is desirable that the toy be of simple design to permit easy repair, preferably by children themselves.

SUMMARY OF THE INVENTION

The toy of the present invention includes a puppet having operable limbs, and a game for use of the same. The puppet toy includes a configured body support that can be grasped by an operator during use of the toy, on which is pivotally carried one or more operable limb assemblies. Each limb assembly includes an upper limb element which is pivotally connected to the body support, an extending limb element which is integral with and pivotally carried on the upper limb element, and activation means for activating the upper limb element and the extending limb element. The upper limb element and the extending limb element have an at-rest and a striking position, while the activation means includes a triggering means for controlling the activation means, allowing the limb assemblies to operate between the at-rest and striking positions. Resilient return means returns the limb assembly to the at-rest position from the striking position when not activated by the activation means. The triggering means is disposed so as to allow an operator to grasp and carry the body support in one hand while at the same time controlling the activation means with the same hand. The limb assembly is fabricated from a suitable thermoplastic material which will permit the interface between the upper limb and extending limb to flex permitting movement of one with respect to the other without fracture.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawing is for the purpose of illustration and description only and is not intended as a definition of the limits of the invention.

DETAILED DESCRIPTION OF THE PREFERRED EMBODIMENT

Figure 3:
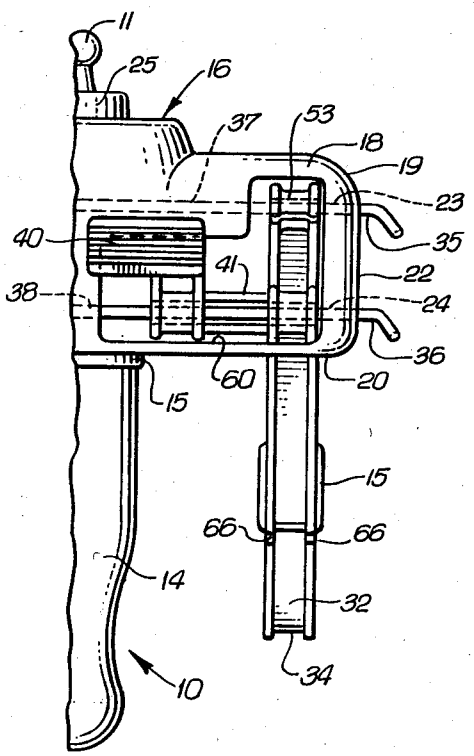
FIG. 3 is a partial cutaway rear elevation view of the body and limb assembly of the action toy shown in FIG. 1.
Figure 2:
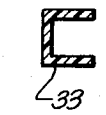
FIG. 2 is a cross-sectional view of the extending limb element taken through line 2—2 of FIG. 1.

In the preferred embodiment, the action toy in accordance with the present invention is shown in FIGS. 1–4 and includes a configured body support 10. Body support 10 includes coupling element 11 which constitutes a ball which can be received in a conventional ball and detent coupling structure. The head assembly which would be attached to coupling element 11 can be made in a variety of caricatures depending upon the use to which the present invention is employed. Limb assembly 12 is pivotally coupled to body support 10 in the manner which will be described in detail below. The free ends of limb assemblies 12 are covered by simulated hands or similar striking surfaces 13.

Figure 1:
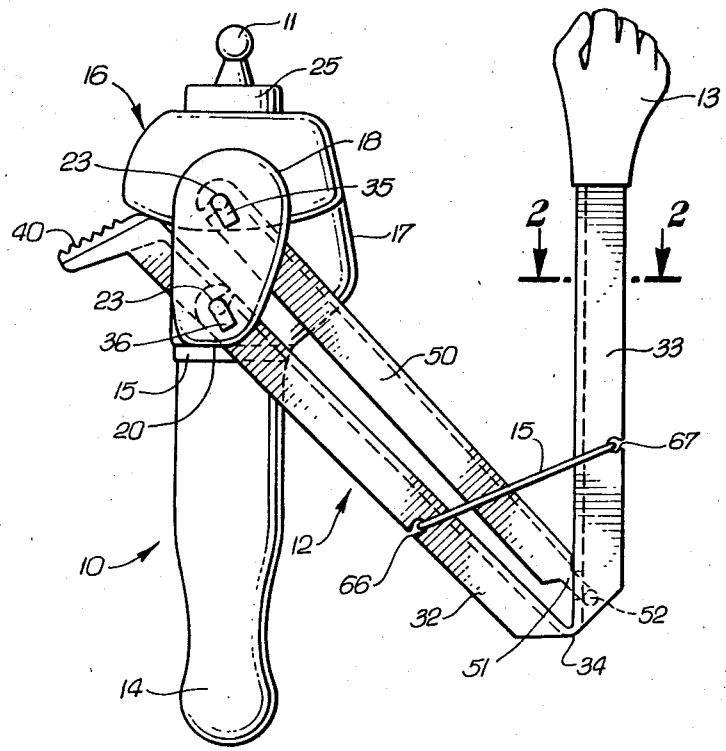
FIG. 1 is a side elevation view of a hand puppet action toy in accordance with the present invention.

The present invention toy is grasped and carried by the body support 10 in one hand of an operator, while the limb assemblies 12 are operated by the same hand of the operator. When activated, limb assemblies 12 extend from an at-rest position, as shown in FIG. 1, to the striking position shown in FIG. 4.

Configured body support 10 has a handle 14 which can be grasped in one hand of an operator. Above handle 14 is a pivot area 15 which has a generally rectangular configuration to simulate the upper body portion 16 of the toy. The coupling of limb assemblies 12 to the upper body portion will be explained in detail hereinbelow. The front of body area 16 extends forward into a protruding chest area 17 which has an angled forward surface shown in FIG. 1. Chest area 17 prevents an operator's hand from sliding up handle 14 during operation of the action toy. Above pivot area 14 are extended shoulders 18 which protrude from opposite sides of the upper body 16. Shoulders 18 have curved upper surfaces 19 and flattened lower surfaces 20. At the terminus of each extended shoulder 18 is a flattened area 22, having upper and lower apertures 23 and 24 therein. Projecting upwardly from the center of shoulders 18 is a short, cylindrical neck 25. As stated previously, coupling element 11 is mounted adopt neck 25 and is adapted to be received within a detent located at the bottom of a puppet head.

Pivotally connected to upper body 16 are two limb assemblies 12 which provide operable arms for the present invention action toy. Each limb assembly 12 comprises an upper limb element 32 and a depending forearm element 33. Upper limb element 32 and lower forearm element 33 are fabricated by molding an appropriate thermoplastic or lastomeric material such that the integral portion 34 connecting upper arm 32 and forearm 33 is pliable and permits forearm 33 to move with respect to upper arm 32 without fracturing. Integral coupling 34 operates as a hinge about which forearm 33 will pivot.

The majority of upper arm 32 extends forward from upper body 16 at a downward angle when in the at-rest position. As can be seen from FIG. 2, the cross-section profile of upper limb element 32 and forearm element 33 is U-shaped. A preferred embodiment for the assembly of the present invention can be best seen by reference to FIGS. 3 and 4. Assembly pins 35 and 36 are disposed through apertures 23 and 24 respectively at each shoulder surface 22, attachment pins 35 and 36 being disposed through interior apertures 37 and 38 respectively. Trigger 40 is secured to shaft 41 through which attachment pin 36 is axially disposed. The upper end 42 of upper limb element 32 is secured about shaft extension 43. As can be best seen in FIG. 4, downward force on trigger 40 will cause counterclockwise rotation of shaft 41 and upper limb element 32. As can be best seen in FIG. 3, trigger 40 is located at the rear of upper body portion 16 for contact by the operator's thumb. Trigger 40 is located a slight distance rearward from upper body 16 so as to be comfortably reached by the thumb of a child which is using the same hand as grasping handle 14.

Figure 4:
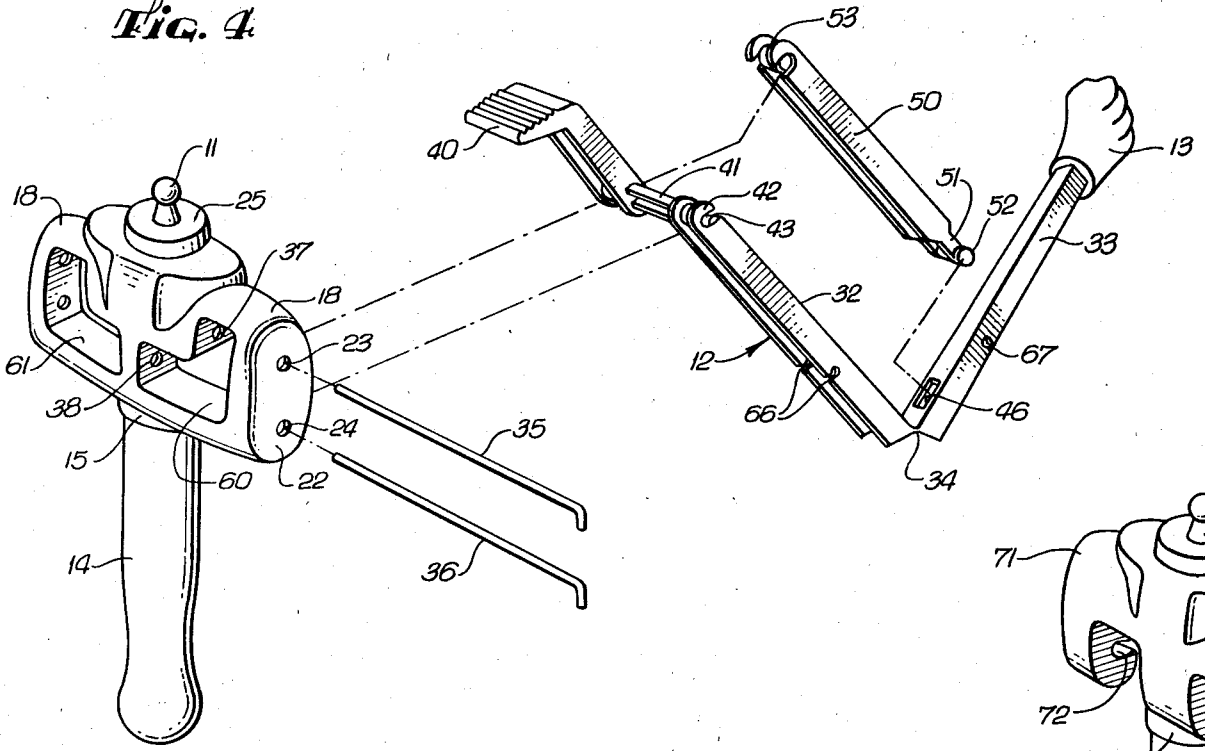
FIG. 4 is a partial assembly view of the present invention action toy.

As stated hereinabove, element 33 is pivotally coupled to upper arm 32 by the integral pivot coupling 34 formed during the molding process. Pivot coupling 34 operates as an elbow joining forearm 33 to upper arm 32. While in the at-rest position, forearm 33 projects generally upward from upper arms 32 as shown in FIG. 4. Displaced from pivot coupling 34 toward the free end of forearm 33 is actuating arm aperture 46 which is best seen in FIG. 4. The free end of forearm 33 terminates in an enlarged hand area 13.

Pivotally connected to upper body 16 and forearm 33 is actuating arm 50 which operates as an actuating linkage as a portion of the actuating means for limb assembly 12. Actuating arm 50 is fabricated from a suitable thermoplastic, and like limb assembly 12, is of a U-shaped construction. The lower end of actuating rod 50 comprises a depending shaft 51 which terminates in outwardly projecting lobes 52 which are adapted to be received within actuating arm aperture 46. When inserted within actuating arm aperture 46, projecting lobes 52 will allow actuating arm 50 to pivot with respect to forearm 33 but will prevent inadvertent separation of actuating arm 50 from forearm 33. The upper coupling between actuating arm 50 and upper body portion 16 can be best seen by reference to FIG. 3. The upper end of actuating arm 50 is adapted to be snapped about and secured to attachment pin 35. As shown in FIGS. 3 and 4, attachment pin 35 depends through apertures 23 and 37. Gripping element 53 of actuating arm 50 secures actuating rod 52, attachment pin 35 while permitting the actuating arm to rotate about the axis of attachment pin 35.

Although FIGS. 1 and 3 illustrate only a single limb assembly being mounted within cavity 60 of upper body 16, it is understood that a mirror image of limb assembly 12, actuating arm 15, shaft 41 and trigger 40 are comparably mounted within cavity 61. In addition, since limb assemblies 12 are to be constructed in a unitary manner in order to provide for integral coupling 34, these elements are preferably fabricated from a suitable lastomeric or thermoplastic substance such as polypropylene, polyethylene, nylon or acetal. Although not shown, upper body 15 is adapted to receive a garment which will cover limb assemblies 12 and actuating arms 50. The only portion which is uncovered being the extensions of forearm 33 which would typically comprise hands 13.

In operation, the user grasps handle 14 and places his thumb over trigger 40. Due to the bent configuration of triggers 40 and their location in pivot area 14, triggers 40 are easily operated by the same hand that holds handle 14. Triggers 40 of the two limb assemblies 12 are located sufficiently close together so that an operator can depress either trigger 40 independently, or both triggers 40 simultaneously if so desired.

Operation of each limb assembly 12 is controlled by a respective trigger 40. Referring to FIG. 1, as trigger 40 is depressed, upper arm 32 pivots counterclockwise about attachment pin 36. Since distances between attachment pin 36 and attachment pin 35, between attachment pin 36 and integral coupling hinge 34, between coupling pin 34 and aperture 46, and along the length of actuating arm 50 each remain constant and form a quadrangle, as upper limb element 32 rotates counterclockwise forearm element 33 simultaneously rotates in the opposite direction downwardly increasing the angle between upper limb element 32 and forearm element 33. This causes hand 13 to extend forwardly from upper body 16 and shifts limb assembly 12 from an at-rest position to a striking position. A resilient band or O-ring (FIG. 1) is disposed about upper arm receiving channels 66 and forearm receiving channels 67. Upon the release of trigger 40, resilient band 65 urges channels 66 and 67 toward each other resulting in the change of limb assembly 12 from a striking position to an at-rest position.

Figure 5:
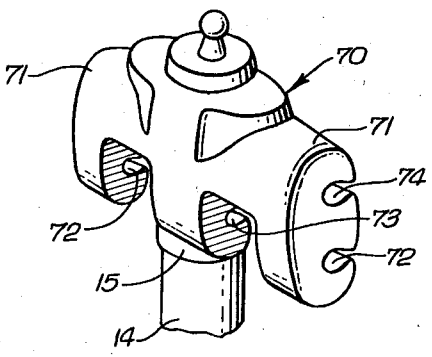
FIG. 5 illustrates an alternative embodiment of the upper body portion of the present invention action toy.

Referring now to FIG. 5, an alternative embodiment for the construction of upper body 16 can be best seen. Handle 14 is coupled to the pivot area 14 in the same manner as that described with respect to FIGS. 1–4, inclusive. In the embodiment shown in FIG. 5, upper body 70 is extended into shoulders 71. The embodiment of the present invention shown in FIGS. 1–4, inclusive, employs a line aperture 23 and 37 for alignment of attachment pin 35 and apertures 24 and 38 for the alignment of attachment pin 36. The embodiment of the present invention shown in FIG. 5 replaces the apertures used to align attachment pin 36 with recessed channels 72 and 73. In a like manner, recessed channel 74 and one aligned through the central body portion replaces the apertures used to mount attachment pin 35. In the alternative embodiment of the present invention, the shafts are secured by force fitting the attachment pin through the impinging lobes of the recessed channels 72, 73 and 74. The frictional fit will preclude inadvertent dislodgement of the respective attachment pins 35 and 36.

I claim:

1. A puppet toy, comprising:

(a) a configured body support;

(b) an integral limb assembly comprising an upper limb element and a forearm element, each comprising a base wall and a pair of integral, perpendicular side walls, said upper limb element being pivotally carried by said body support at a first pivot point, the base wall of said upper limb element depending into said forearm element along the base wall of said forearm element, said forearm element being pivotally carried on said upper limb element at a second pivot point located at the joinder of said base walls, said second pivot point comprising an integral extension of said base walls which is reduced in thickness from that of said base walls whereby said forearm element can pivot with respect to said upper limb element by the flexing movement of said integral extension, said forearm limb element having a free end displaced from said second pivot point, said upper limb element and said forearm limb element having an at-rest position and a striking position;

(c) activation means for activating said upper limb element and said forearm limb element such that said upper limb pivots about said first pivot point in a first direction of rotation and said depending forearm element simultaneously pivots about said second pivot point in a second direction of rotation opposite to said first direction of rotation, so as to extend said free end of said extendng limb forward to said body support from said at-rest position to said striking position, said activation means including a first triggering means for controlling said activation means, said first triggering means disposed relative to said body support so as to allow an operator to grasp and carry said body support in one hand while controlling said activation means simultaneously with the same hand; and (d) resilient means for biasing said upper limb and said forearm limb to said at-rest position.

2. A puppet toy as defined in claim 1 in which said activation means includes an actuating arm having a first end pivotally connected to said body support at a third pivot point displaced from said first pivot point, and a second end pivotally connected to said forearm limb element at a fourth pivot point displaced from said second pivot point, and said first triggering means includes a first lever connected to said upper limb and disposed to allow an operator to operate said first lever with one finger or a thumb of the hand grasping said body support.

3. A puppet toy as defined in claim 2 wherein said upper limb, forearm limb and activation arm comprise a first limb assembly, and said puppet toy further comprises a second limb assembly carried on said body support, said second limb assembly disposed so as to allow an operator to grasp and carry said body support in one hand while controlling said first and second limb assemblies with the same hand.

4. A puppet toy as defined in claim 3 in which said second limb assembly includes a second triggering means comprised of a second lever disposed such that an operator can operate both said first lever and said second lever with the same finger or thumb, allowing said first and second limb assemblies to be operated either independently or simultaneously.

5. A puppet toy as defined in claim 2 wherein said return means comprises a resilient rubber ring coupled about side walls of said upper limb element and depending forearm element.

6. A puppet toy as defined in claim 1 in which said limb elements are made of a thermoplastic material.

* * * * *